US008118588B2

(12) United States Patent
Lifshits

(10) Patent No.: US 8,118,588 B2
(45) **Date of Patent: *Feb. 21, 2012**

(54) ENERGY EFFICIENT LOW $NO_x$ BURNER AND METHOD OF OPERATING SAME

(75) Inventor: Vladimir Lifshits, Redwood City, CA (US)

(73) Assignee: Coen Company, Inc., Foster City, CA (US)

( * ) Notice: Subject to any disclaimer, the term of this patent is extended or adjusted under 35 U.S.C. 154(b) by 670 days.

This patent is subject to a terminal disclaimer.

(21) Appl. No.: 12/220,413

(22) Filed: Jul. 23, 2008

(65) Prior Publication Data

US 2008/0293002 A1 Nov. 27, 2008

Related U.S. Application Data

(62) Division of application No. 11/067,312, filed on Feb. 25, 2005, now Pat. No. 7,422,427.

(60) Provisional application No. 60/547,924, filed on Feb. 25, 2004.

(51) Int. Cl.
*F23C 9/00* (2006.01)

(52) U.S. Cl. ..... 431/116; 431/159; 431/174; 431/278

(58) Field of Classification Search ..... 126/116, 126/278, 284, 285, 9; 431/116 R, 278, 284, 431/285, 9, 174, 159; 110/204
See application file for complete search history.

(56) References Cited

U.S. PATENT DOCUMENTS 4,575,332 A * 3/1986 Oppenberg et al. ..... 431/9
5,299,930 A * 4/1994 Weidman ..... 431/10
5,460,512 A * 10/1995 Lifshits et al. ..... 431/9
7,422,427 B2 * 9/2008 Lifshits ..... 431/116

* cited by examiner

*Primary Examiner* — Alfred Basichas
(74) *Attorney, Agent, or Firm* — Kilpatrick Townsend & Stockton LLP

(57) ABSTRACT

A burner assembly that produces very low $NO_x$ emissions includes a plurality of furnace gas openings for receiving a portion of furnace gasses back into a combustion cylinder. The burner assembly includes the combustion cylinder, a plurality of combustion air inlet conduits that extend into the cylinder and a plurality of fuel gas discharge nozzles that also extend into the cylinder. The burner assembly is mounted within a combustion chamber of a furnace, wherein the walls of the combustion chamber are provided with or are made up of heat transfer pipes. Thus, in operation, furnace gasses exit the combustion cylinder and, due to combined aspirating action created by air jets as they exit the air conduits and fuel gas jets discharging from the fuel gas discharge nozzles inside the combustion cylinder and a pressure differential between the combustion cylinder and the combustion chamber, a portion of the furnace gasses flow from the outlet of the combustion cylinder and past the heat transfer pipes toward the proximal or upstream end of the combustion cylinder. Passage of the furnace gasses past the heat transfer pipes cools the furnace gasses and the furnace gasses then flow through the furnace gas openings and mix with the combustion air and fuel gas to provide a lower $NO_x$ emission in an energy-efficient manner.

12 Claims, 2 Drawing Sheets

ENERGY EFFICIENT LOW $NO_x$ BURNER AND METHOD OF OPERATING SAME

CROSS-REFERENCES TO RELATED APPLICATIONS

This is a divisional application of application Ser. No. 11/067,312 filed Feb. 25, 2005, now U.S. Pat. No. 7,422,427, which claims the benefit of Application No. 60/547,924 filed Feb. 25, 2004 entitled "Energy Efficient Low $NO_x$ Burner And Method Of Operating Same", the disclosures of which are incorporated herein by reference.

BACKGROUND OF THE INVENTION

1. Field of the Invention

The present invention relates to fuel gas burners that have very low $NO_x$ emissions and, in particular, to such burners that operate with flue gas recirculated into the combustion chamber.

2. Description of the Prior Art

There are three basic sources/mechanisms of $NO_x$ formation during the process of flame combustion. One is thermal $NO_x$ formed in the flame at high temperature by oxidation of atmospheric nitrogen (N2) present in combustion air or otherwise mixed with fuel. The amount of thermal $NO_x$ typically increases exponentially with the increase in peek flame temperature. Typical range of uncontrolled thermal $NO_x$ in boilers, or process heaters, is 60 to 400 ppm. A second is $NO_x$ formed from fuel bound nitrogen—FBN (this does not include atmospheric nitrogen). With small quantities of FBN this $NO_x$ is proportional to the FBN in fuel. A third is prompt $NO_x$ that is formed from atmospheric nitrogen via reactions with hydrocarbon radical present in the flame during oxidation. The residence time of this radical is relatively small and so is prompt $NO_x$. Its typical range is from 2 ppm to 10-15 parts per million (ppm) and thus is important only when levels of $NO_x$ below 20-25 ppm are desired.

Many common fuels like natural gas, refinery gas and diesel oil have little or no fuel bound nitrogen. For these fuels, the main source of $NO_x$ is thermal $NO_x$.

The main technique of controlling thermal $NO_x$ in boilers and heaters is by diluting the air fuel mixture with some substantially inert media (cooled combustion products—flue gas recirculation, steam, water injection, etc.) that absorbs some heat released during the combustion and lowers peak flame temperatures. In some combustion devices (premixed type combustion), increased excess air can be used instead of inert media to achieve the same dilution effect.

In most cases the inert media is recirculating flue gas, as it typically has minimal adverse effects on the process thermal efficiency and is most readily available. At the same time, however, recirculation of the flue gas substantially increases the energy required for passing the mixture flow of combustion air and added flue gas through the system. An addition of 10% of flue gas recirculation (FGR) from the existing boiler exhaust back to the burner, for example, typically results in a 40-45% increase in the required power of the fan. This is especially critical in retrofits of large boilers with high-pressure losses through its convection passes.

There are some advanced burners that utilize the pressure energy of fuel to promote internal circulation of the flue gas inside the boiler, or heater radiant section. The effectiveness of these devices depends strongly on the temperature of gas surrounding the flame body. In large boilers, the furnace gas surrounding the flame has a temperature not much lower than the peek flame temperature. Thus, its effect on reducing the flame temperature and thermal $NO_x$ is greatly diminished. Recirculation of the gas within the confines of the radiant section back into the flame body does not increase the flow through the convection section of the boiler and through the fan. Thus, it does not impact directly the required fan horsepower.

There are also devices that use energy from high velocity combustion air jets to promote recirculation within the radiant section. The effectiveness of these techniques depends on the available burner pressure drop and temperature of furnace gas that is being mixed with combustion air. It is usually justified in boilers with low heat release. In boilers with high space heat release, the cross section of the furnace (boiler radiant section) is comparable to the flame cross section. In such boilers the temperature of gas surrounding the flame at the furnace front is substantially higher than in more liberal boilers. So the effectiveness of this gas for the purpose of flame temperature reduction and $NO_x$ control is diminished. The average velocity of combustion products through the furnace is also higher in high space release boilers. This makes it more difficult to return a substantial portion of combustion products back to the burner.

In addition to the factor of increased operating costs of burners with high amounts of FGR, another problem in achieving very low $NO_x$ levels, typically below 10 ppm, is maintaining a stable flame without strong oscillations. Overcoming this problem has typically required more expensive combustion controls with improved accuracy.

SUMMARY OF THE INVENTION

The present invention provides a burner assembly that emits a lower level of $NO_x$, is energy-efficient and has improved flame stability. The burner assembly is placed inside the radiant section of a boiler near its front wall. The main component of the burner is an open-ended cylinder or tubular member that is open at its distal end. A plurality of combustion air ports extend into the cylinder from a proximal end of the cylinder and are coupled to a source of combustion air. The source of combustion air may supply a mixture of combustion air and flue gas from the boiler stack. The burner assembly further comprises a plurality of fuel gas discharge nozzles extending into the cylinder from its proximal end that are coupled to a fuel source. Finally, the burner assembly comprises a plurality of furnace gas openings defined in the cylinder and spaced around the cylinder's circumference at the boiler front wall. The diameter of the cylinder varies with the burner design capacity, furnace cross section and other design parameters like the required burner turndown, limits on the air pressure losses as it passes through the burner and some other factors. The length of the cylinder typically varies between one and two cylinder diameters depending on the furnace length and some other parameters.

In accordance with one aspect of the present invention, the plurality of furnace gas openings are equally spaced around the cylinder's circumference.

In accordance with another aspect of the present invention, the assembly comprises four to eight furnace gas openings.

In accordance with yet another aspect of the present invention, the plurality of furnace gas openings have a substantially rectangular shape.

In accordance with a further aspect of the present invention, the plurality of rectangular furnace gas openings have a total open area that is at least as large as the cross sectional area of the cylinder.

In accordance with another aspect of the present invention, the plurality of combustion air ports have one of a substantially circular or trapezoidal shape and are uniformly spaced around a longitudinal axis defined by the center of the cylinder.

In accordance with a further aspect of the present invention, the plurality of combustion air ports have a total cross sectional area between 20 to 30% of the cross sectional area of the cylinder.

In accordance with another aspect of the present invention, the burner assembly further comprises a spinner coupled to a distal end of the cylinder.

In accordance with a further aspect of the present invention, the burner assembly further comprises a plurality of fuel discharge nozzles adjacent the open end of the cylinder.

In accordance with a further aspect of the present invention, the plurality of fuel gas discharge nozzles extend into the cylinder a distance equal to or less than approximately the diameter of the cylinder. The fuel gas discharge nozzles inject fuel in a predominantly axial direction toward the distal end of the cylinder. The fuel gas discharge nozzles are staggered in relation to the combustion air ports.

The present invention also provides a method of creating a stable flame with very low $NO_x$ emissions, typically below 10 ppm, where the method comprises providing combustion air through combustion air inlets to an open-ended cylinder comprising a proximal end and a distal end, and providing fuel gas to the cylinder through fuel gas inlets. The method further comprises flowing the combustion air, which in some cases may be mixed with flue gas from the boiler stack, a portion of furnace gas and a portion of the fuel gas, toward the open end of the open-ended cylinder located at the distal end and igniting the fuel gas mixed with furnace gas and combustion air after discharging through the open end to create combustion products gas or furnace gas. The method further comprises flowing of a portion of the furnace gases around the burner toward the front of the boiler radiant section past water-cooled walls. This portion of the flame gases then flows back into the open-ended cylinder through furnace gas openings defined within the cylinder and spaced around the cylinder's circumference. The flowing of the portion of the furnace gases occurs due to combined aspirating action created by air jets as they exit the air ports and fuel gas jets discharging from the nozzles inside the open-ended cylinder.

Other features and advantages of the present invention will be apparent upon review of the following detailed description of preferred exemplary embodiments.

DETAILED DESCRIPTION OF THE INVENTION

Figure 1:
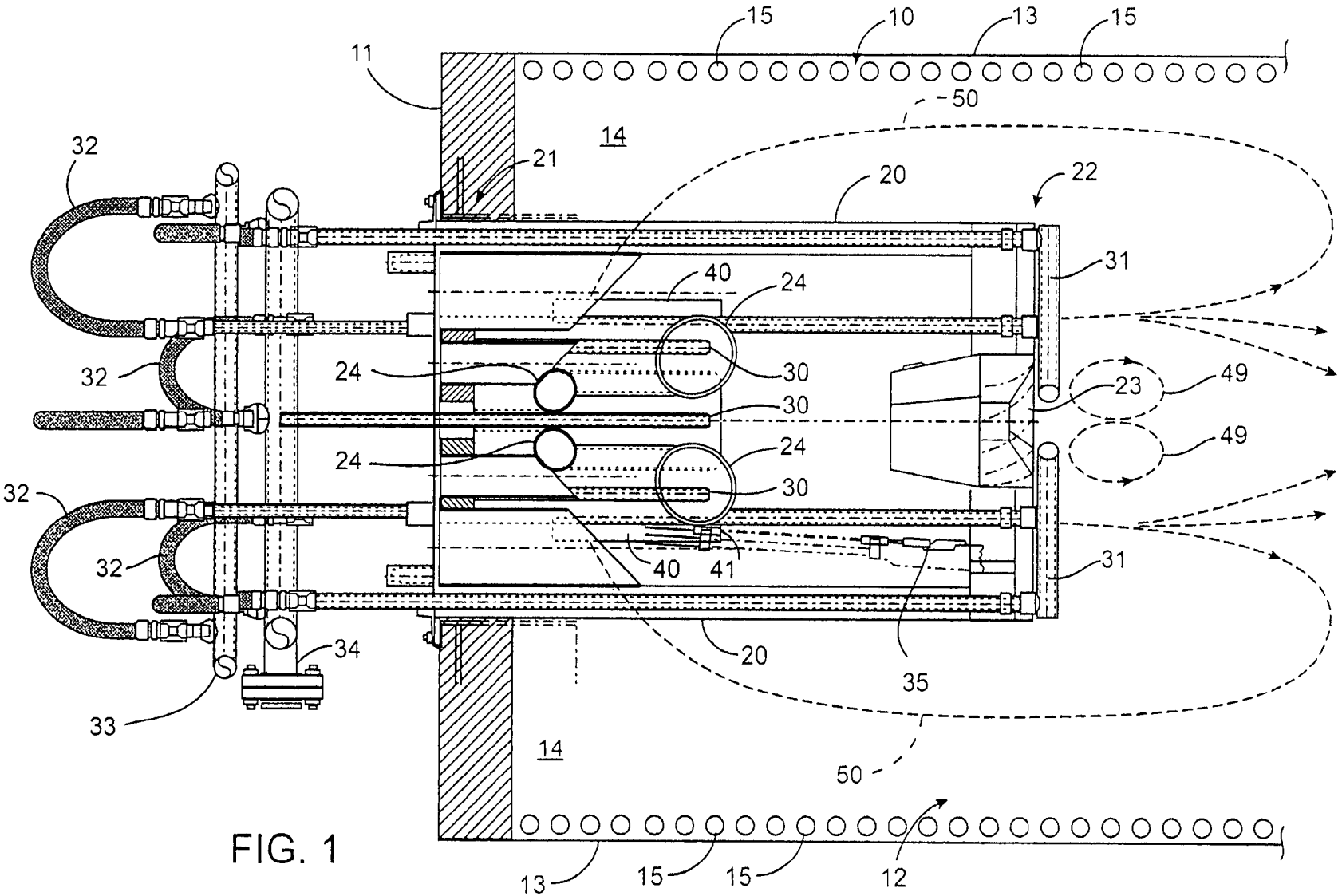
FIG. 1 is a side sectional view of a burner assembly in accordance with the present invention.
Figure 2:
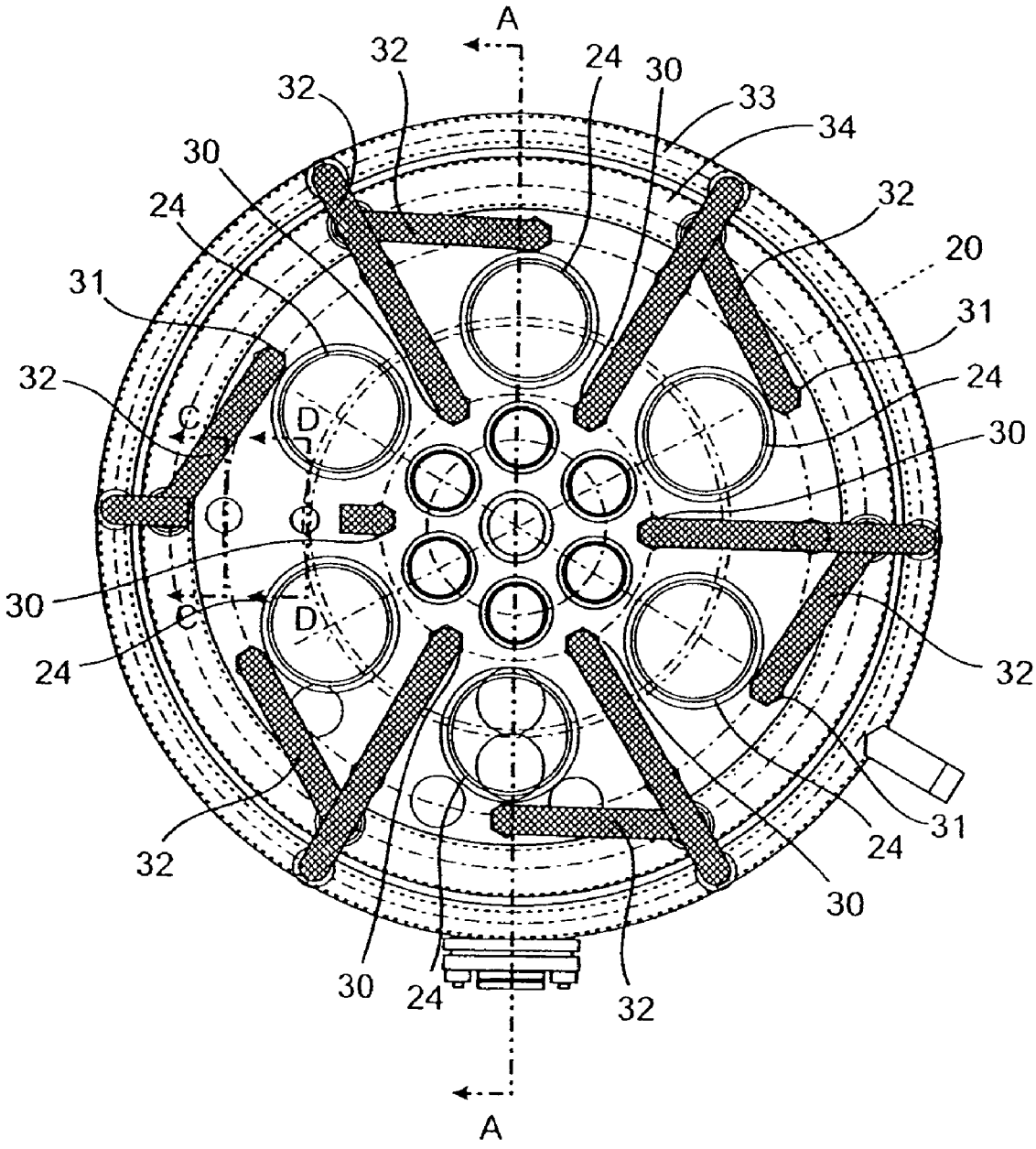
FIG. 2 is a rear elevational view of a burner assembly in accordance with the present invention.

With reference to FIG. 1, a burner assembly 10 in accordance with the present invention is mounted to a furnace front wall 11 that defines a combustion chamber 12 along with two side walls 13, a top wall (not shown), and a bottom wall 14. The burner assembly projects downstream into the combustion chamber. At least some of the chamber walls are cooled by a heat transfer media. In a preferred embodiment, the walls are comprised of pipes 15 and the heat transfer media is water. These pipes, due to the heat transfer media, absorb heat from the flame and gases within the combustion chamber.

Burner assembly 10 includes a cylindrical body or tubular member 20 mounted on one end to the furnace front wall 11. This end of the cylinder includes a plurality of combustion air ports 24 extending from an air source, generally the wind box of the burner assembly (not shown), through the thickness of the furnace front wall so that combustion air flows through ports 24 into cylindrical body 20. Preferably, the cylinder is made of a heat resistant stainless steel alloy. In a preferred embodiment, ports 24 have substantially circular or trapezoidal shape and are uniformly spaced around the longitudinal axis of the burner defined by the cylinder centerline. Preferably, the plurality of ports 24 have a combined total cross sectional area between 20 to 30% of the circular cross sectional area of the cylinder.

Those skilled in the art will understand that the diameter of the cylinder and size of the ports vary with the burner design capacity, furnace cross section and other design parameters like the required burner turndown, limits on the air pressure losses as it passes through the burner and some other factors. The length of the cylinder typically varies between one and two cylinder diameters depending on the furnace length and a few other parameters.

Downstream or distal end 22 of cylinder 20 is substantially open. Another component of the burner is a spinner 23 centrally mounted adjacent or even within the open end of the cylinder. Combustion air flows through ports 24 into cylinder 20 predominantly in a downstream direction toward spinner 23.

In accordance with the present invention, cylinder 20 includes a plurality of furnace gas openings 40 defined within the cylinder around its periphery. There may be between four and eight furnace gas openings 40, and in a preferred embodiment, six furnace gas openings 40 are provided. Additionally, in a preferred embodiment, the flame gas openings are equally distributed about the cylinder circumference and are located in close proximity to upstream end 22 of the cylinder, as may be seen in FIG. 1. Furnace gas openings 40 and combustion air conduits 24 are placed in a staggered arrangement. Preferably, furnace gas openings 40 have a substantially rectangular shape. Preferably, the total open area of all of the furnace gas openings combined is at least as large as the circular cross sectional area of the cylinder.

Burner assembly 20 further includes fuel gas discharge nozzles 30 that extend between 25 and 60% of the cylinder length into cylinder 20. In a preferred embodiment, and in the embodiment illustrated in the figures, six fuel gas discharge nozzles 30 are provided. Nozzles 30 are preferably placed in line with the end of furnace gas openings 40, or inserted into cylinder 20 to a distance equal to or less than approximately the diameter of the cylinder. The fuel gas discharge nozzles inject fuel in a predominantly axial direction toward distal end 23 of the cylinder. Fuel gas discharge nozzles 30 are staggered axially in relation to combustion air conduits 24.

Additionally, in a preferred embodiment, radially inwardly oriented fuel discharge nozzles 31 are located at downstream end 22 of cylinder 20. Nozzles 31 are preferably placed in line with combustion air ports 24.

Pipes or other appropriate conduits 32 from appropriate fuel gas manifolds 33, 34 along the exterior of furnace wall 11 provide fuel gas to nozzles 30 and 31. An igniter 35 is provided prior to spinner 23 to ignite the fuel gas and air mixture.

In use, combustion air which, independent of the present invention, may include external flue gas recirculation (FGR) enters the interior of cylinder 20 through combustion air ports 24. Once the burner is operating, furnace gases are also introduced into cylinder 20 through furnace gas openings 40 as described below.

The furnace gas is mixed with fuel gas from fuel gas discharge nozzles 30 and flows in a downstream direction toward spinner 23 and then into combustion chamber 12. On its way the mixture of fuel from nozzles 30 and furnace gases gradually entrains and mixes with combustion air entering the cylinder through ports 24. The combined mixture ignites in the combustion chamber 12 from the flame created by burning fuel delivered through nozzles 31 and is stabilized by a recirculation zone 49 in the wake of spinner 23. Burning of fuel in chamber 12 produces a flame that forms high temperature combustion products—furnace gas.

The flowing of the portion of the furnace gases through openings 40 occurs due to combined aspirating action created by air jets as they exit air ports 24 and fuel gas jets discharging from nozzles 30 inside open-ended cylinder 20. As a result of the relatively high kinetic energy of the furnace gases traveling through openings 40, the pressure in cylinder 20 at discharge end 41 of openings 40 is relatively low while the pressure in combustion chamber 12 is relatively higher so that a portion of the furnace gases in combustion chamber 12 circulates rearwardly towards openings 40 and back into the cylinder, where it mixes with fresh combustion air and fuel gas, as is indicated by circulation line 50. The recirculating furnace gases are exposed to and transfer heat to pipes 15, thereby cooling to a temperature that may be as low as 1200-2000° F. The maximum temperature of the flame gases in the combustion chamber is typically above 2800° F. As a result, the flame temperature in the combustion chamber will be lowered as compared to what it would be if the burner were fired with combustion air (with or without external FGR) only, thereby lowering the $NO_x$ emissions of the burner. In spite of a significant dilution of the components entering the flame zone with inert gases, the flame experimentally was found very stable and not prone to generating combustion driven oscillations detrimental to the process.

Since the additional furnace gas circulation in accordance with the present invention takes place only between downstream end 22 of cylinder 20 and openings 40, the overall gas flow through an exhaust fan (not shown) is not increased, which saves installation costs (no new ducting required) and operating costs (no increase, or minimum increase, in fan size is necessary).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is intended that the scope of the invention be defined by the claims appended hereto and their equivalents.

What is claimed is:

1. A burner assembly producing low $NO_x$ emissions, the assembly comprising:

a tubular member having an axis and an open distal end;

a plurality of combustion air ports extending into the tubular member from a proximal end of the member and coupled to a combustion air source;

a plurality of fuel gas discharge nozzles extending into the tubular member from the proximal end of the member and adapted to be coupled to a fuel source; and a plurality of furnace gas openings extending transversely to the axis through a tubular wall of the tubular member oriented substantially perpendicular to the axis and located upstream of the distal end.

2. A burner assembly in accordance with claim 1 wherein the plurality of furnace gas openings are equally spaced around the tubular member's periphery.

3. A burner assembly in accordance with claim 1 comprising between four and eight furnace gas openings.

4. A burner assembly in accordance with claim 3 comprising six furnace gas openings.

5. A burner assembly in accordance with claim 4 wherein the six flame gas openings are equally spaced around the tubular member's periphery.

6. A burner assembly in accordance with claim 1 wherein the plurality of furnace gas openings are elongated in the direction of the axis.

7. A burner assembly in accordance with claim 6 wherein the plurality of furnace gas openings have a combined total open area that is at least as large as the tubular member's circular cross-sectional area.

8. A burner assembly in accordance with claim 1 wherein the plurality of combustion air ports have a substantially circular shape and the combustion air ports are uniformly spaced around a longitudinal axis defined by the axis.

9. A burner assembly in accordance with claim 8 wherein the plurality of combustion air ports have a combined total cross-sectional area between 20 to 30% of the tubular member's cross-sectional area.

10. A burner assembly in accordance with claim 1 further comprising a spinner coupled to a distal end of the cylinder.

11. A burner assembly in accordance with claim 1 further comprising a plurality of fuel discharge nozzles adjacent the open end of the tubular member.

12. A burner assembly in accordance with claim 1 wherein the fuel gas discharge nozzles extend into the tubular member a distance not greater than a diameter of the tubular member and are staggered in relation to the combustion air ports.

* * * * *